United States Patent [19]

Raubenheimer

[11] Patent Number: 4,536,908

[45] Date of Patent: Aug. 27, 1985

[54] SUCTION CLEANERS

[75] Inventor: Johann N. Raubenheimer, Bedfordview, South Africa

[73] Assignee: Peacock Investments (Proprietary) Limited, Johannesburg, South Africa

[21] Appl. No.: 480,360

[22] Filed: Mar. 30, 1983

[30] Foreign Application Priority Data

Apr. 2, 1982 [ZA] South Africa ..... 82/2293

[51] Int. Cl.[3] ..... E04H 3/20

[52] U.S. Cl. ..... 15/1.7; 180/8.1

[58] Field of Search ..... 15/1.7, 340; 180/8.1, 180/8.4, 1.181, 1.182, 1.183, 1.184

[56] References Cited

U.S. PATENT DOCUMENTS 3,803,658 4/1974 Raubenheimer ..... 15/1.7

FOREIGN PATENT DOCUMENTS 2612043 9/1977 Fed. Rep. of Germany ..... 15/1.7

*Primary Examiner*—Edward L. Roberts

*Attorney, Agent, or Firm*—Ladas & Parry

[57] ABSTRACT

A suction cleaner for a swimming pool is supported on a bogie with inclined supporting feet resiliently biased. The bogie is rocked by means of a turbine through which water is pulled by suction to cause the bogie and hence the cleaner to move. To cause the cleaner to change direction another turbine intermittently drives a hose connection at the top of the cleaner in opposite directions with long periods of dwell in between.

6 Claims, 4 Drawing Figures

FIG_1
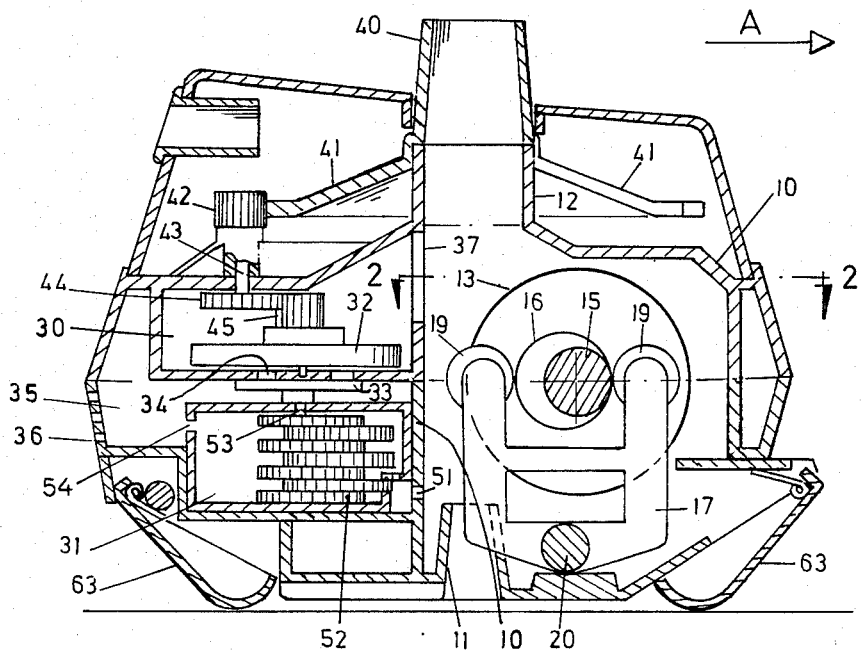
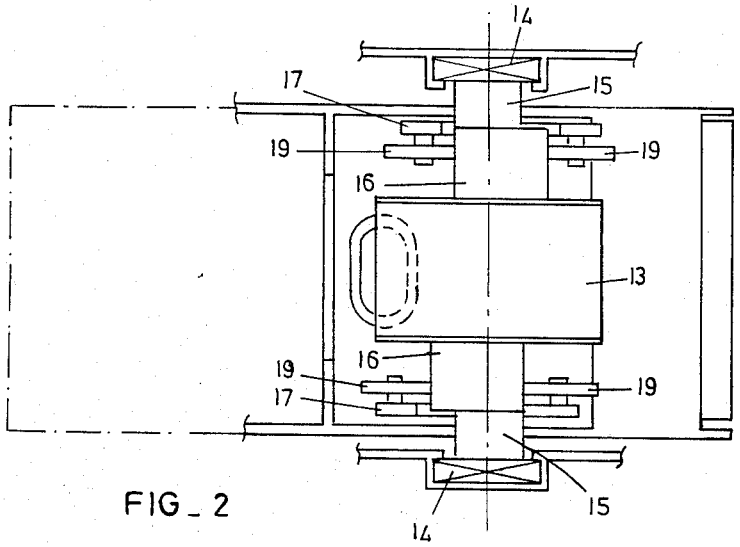
FIG_2

SUCTION CLEANERS

BACKGROUND OF THE INVENTION

This invention relates to suction cleaners for use on a submerged surface of the kind which is connected to suction devices by means of a flexible hose and having a suction head which can move along the surface.

There are cleaners of this kind which are caused to move about in a step by step fashion and in a random manner. Although they are said to operate in various ways, in effect they rely on or cause a pulsating flow.

On the other hand the present inventor has in U.S. Pat. No. 4,434,519 proposed a suction cleaner which causes no significant pulsations in the suction line and permits a better steerway of the head. The latter application describes various forms in all of which the prime mover is a water turbine driven by water flowing through the suction head to the suction hose.

An object of the invention is to provide a further form of the latter kind which, it is believed, will be relatively cheap and easy to manufacture and which will in the preferred embodiment of that form, effectively climb up walls and perform random motions to cover the surfaces to be cleaned.

SUMMARY OF THE INVENTION

A cleaner head according to the invention comprises:

a turbine housing, a suction inlet in the base of the housing, a turbine mounted on a shaft journalled in the housing, an outlet form the housing adapted to be connected to a flexible hose, at least one rocker for supporting the housing at least partially on a surface, the rocker being pivoted to the housing, at least one inclined friction foot on the rocker for contacting the surface, the foot being inclined in a plane transverse to the surface; and at least one eccentric on the turbine shaft and journalled for providing a rocking action to structure fast with the rocker.

There are preferably a pair of rockers each pivoted to the housing, there are a pair of eccentrics on the turbine shaft, each eccentric being journalled for providing a rocking action to structure fast with a rocker, and there is at least one foot for each rocker.

The rockers may be independently pivoted in which case they are 180° out of phase.

The feet should be pivoted to their rockers and resiliently biased to an inclination so that each foot can perform a limited rocking motion relatively to the rocker when forces directed towards the surface are applied to it.

The device thus far recited will on passage of water through it move in a relatively straight line in the direction of upward inclination of the feet. To provide for a change of direction the invention provides that the housing outlet be a hose connection rotatable on the housing and extending oppositely to the suction inlet, and means fast with the housing for intermittently applying torque in opposite directions to the hose connection. In the result the resistance of any attached flexible hose causes the housing to turn while torque is being applied. As soon as the torque is released, the head once more moves in a straight line.

The torque applying means may comprise a separate reversible turbine in a housing attached to the main housing withh a separate inlet and an outlet for the latter housing.

Conveniently the casing for the torque applying turbine has twin inlets, one for each direction of rotation, and control means is provided to open them in turn with a period of dwell when they are both closed. The control means may take the form of a valve plate, suitably apertured, rotating over the twin inlets and driven by a water motor through suitable reduction gearing at the required speed. The water motor is also in a casing with a separate inlet and an outlet to the housing. The water motor may be of the kind used in oscillating sprinklers and suitably geared down.

DESCRIPTION OF THE DRAWINGS

FIG. 1 is a section through a suction head according to the invention,

FIG. 2 is a part plan on the line 2—2 in FIG. 1,

DESCRIPTION OF A PREFERRED EMBODIMENT

Figure 3:
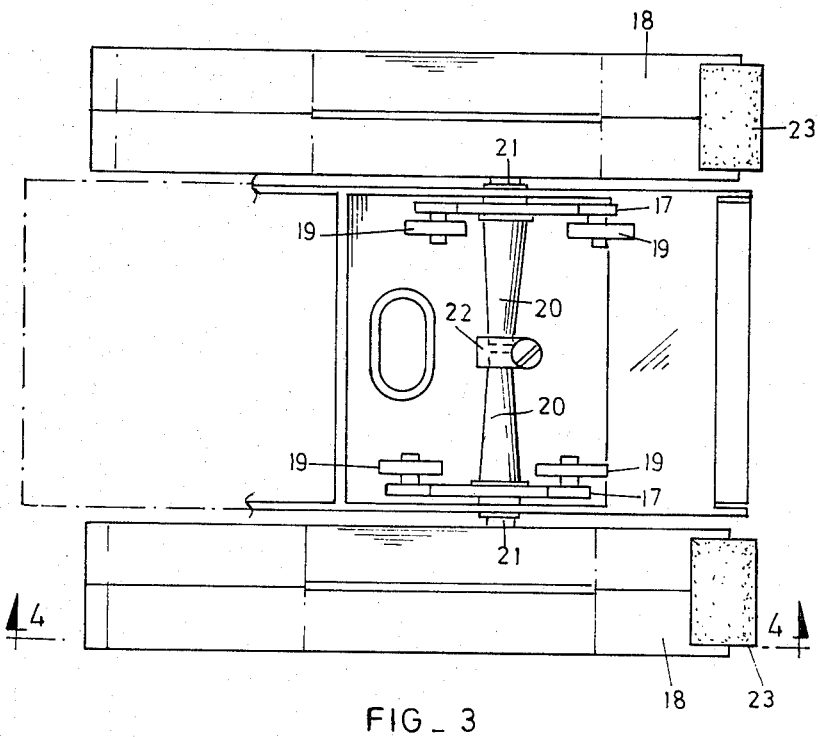
FIG. 3 is a plan on the line 2—2 in FIG. 1 with the turbine removed.

The illustrated suction head has a housing 10 formed at its base with an inlet nozzle 11 and at its top with an outlet 12. A turbine 13 is housed in the housing 10 and journalled to the housing walls by means of bearings 14 on the turbine shaft 15. It will be seen that if water flows from the nozzle 11 to the outlet 12, the turbine 13 will rotate. Also on the shaft 15 are eccentrics 16 which are between discs 19 fitted to cleviced supports 17. The eccentrics are 180° out of phase. As the shaft 15 rotates, the supports 17 will rock to and fro. Each support 17 is integral with a side frame 18 to which it is connected by means of a square end of a shaft 20. The inner ends of the shafts 20 are journalled for rotation in a split bearing 22 on the housing 10. As the supports 17 rock, their movements are imparted to the side frames 18.

Figure 4:
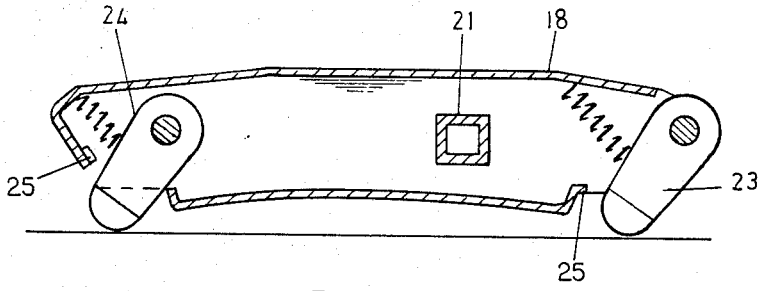
FIG. 4 is a section on the line 4—4 in FIG. 3.

Pivoted on the side frames 18 are pairs of feet 23 and 24 made of a friction material such as rubber. Stops 25 limit the pivotal movement of the feet and springs 26 bias them so that they assume the inclination relatively to a supporting surface shown in FIG. 4.

The result is that as the turbine 13 rotates, the side frames rock and the whole device moves to the right in the direction of the arrow A in FIG. 1.

If the shaft 20 is not split, but continuous, the eccentrics 16 must be in phase. However, the movement obtained in this case is not so quick and positive as with the eccentrics out of phase.

Attached to the housing 10 are two compartments 30 and 31. In the upper compartment 30 there is a reversible turbine 32. Two passages 34 port in the compartment 30 and in the space 35 with an inlet screen 36. The ports in the compartment 30 are controlled by a valve plate 33 the operation of which will be described later on. The outlet from the compartment 30 is at 37.

On the outlet 12 there is rotatably mounted a hose connection 40 which carries a large gear wheel 41. A pinion 42 on a shaft 43 meshes with the gear wheel 41. At its lower end the shaft 43 carries a gear 44 which meshes with a pinion 45 on the shaft of the turbine 32. If the turbine 32 rotates, it will thus apply a high slow speed torque to the connection 40.

In the compartment 31 there is housed a water motor 52 of the type used with oscillating sprinklers and geared down to give a reduction of the order of 2000:1. Water passing through the space 35 enters the compartment 31 through an inlet 54 and leaves into the housing 10 through an outlet 51. The ultimate output of the motor 52 is at a shaft 53 which drives the valve plate 33 which is resiliently biased upwardly.

As the motor 52 rotates the valve plate 33 alternately covers and uncovers the ports 34 with relatively long periods when both parts are covered. As a port 34 is uncovered the turbine 32 applies a torque to the connection 400 which in use is attached to a flexible hose. The hose will resist the turning movement and the net effect is that the whole device turns around the axis of the connection 40. When the then open port is closed, the device will be facing a random new direction usually different from its original direction. Of course, the running of the turbine 13 will constantly tend to move the device in its forward direction at any given time so that in turn a sort of spiral movement will take place.

Suction applied to the device will tend to keep it on any submerged surface on which it rests. To assist this action, the housing 10 is provided with a hydrovane (not shown) which is downwardly inclined relatively to the base of the device in its direction of movement. The housing 10 also carries pivoted flexible side flaps (not shown).

The path to the nozzle 11 is resiliently obstructed by means of curved flaps 63 which are biased by springs, not shown, towards the surface on which the device rests for the time being. As suction takes place, the flaps 63 move inwardly to allow water to reach the nozzle 11. The net effect is that water flows in from the back and the front, but is prevented from coming in from the sides, by the side flaps (not shown).

Briefly then the rotation of the turbine 13 reacts on the feet 23 and 24 to cause the suction head to move in one direction. The motor 52 runs continuously and from time to time opens a port 34 which causes the turbine 32 to apply a torque to the connection 40 and to cause a change of direction either to the left or to the right in the direction of movement. The main flow of water through the turbine 13 is continuous and only the relatively small flow through the turbine 32 is intermittent.

I claim:

1. A suction cleaner head for use on a submerged surface comprising:

a turbine housing, a suction inlet in the base of the housing, a shaft journalled in the housing, a turbine mounted on the shaft, a pair of rockers for supporting the housing at least partially on a surface, each rocker being pivoted to the housing, a pair of eccentrics on the turbine shaft, each eccentric being engaged with one of said rockers for providing a rocking action to a rocker, a pair of spaced apart friction feet pivoted to the underside of each rocker for contacting the surface, means for resiliently biasing each of said feet to an inclination so that each of said feet can perform a limited rocking motion relatively to the rocker when forces directed towards the surface are applied to the rocker, and an outlet from the housing adapted to be connected to a flexible hose.

2. The cleaner head claimed in claim 1 in which the rockers are independently pivoted to the housing and the eccentrics are 180° out of phase.

3. The cleaner head claimed in claim 1 in which the housing outlet is a hose connection rotatable on the housing and extending oppositely to the suction inlet and including means fast with the housing for intermittently applying torque in opposite directions to the hose connection.

4. The cleaner head claimed in claim 3 in which the torque applying means is a separate reversible turbine in a casing attached to the main housing with a separate inlet and an outlet.

5. The cleaner head claimed in claim 4 in which the casing has twin inlets, one for each direction of rotation, and control means to open them in turn with a period of dwell when they are both closed.

6. The cleaner head claimed in claim 5 in which the control means comprises a valve plate suitably apertured rotating over the twin inlets and driven by a water motor through suitable reduction gearing.

* * * * *